US011059698B2

(12) United States Patent
Marante-Chasco

(10) Patent No.: US 11,059,698 B2
(45) Date of Patent: Jul. 13, 2021

(54) ELEVATOR SAFETY GEAR ASSEMBLY

(71) Applicant: Otis Elevator Company, Farmington, CT (US)

(72) Inventor: Ruben Marante-Chasco, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 329 days.

(21) Appl. No.: 16/136,981

(22) Filed: Sep. 20, 2018

(65) Prior Publication Data

US 2019/0092603 A1 Mar. 28, 2019

(30) Foreign Application Priority Data

Sep. 22, 2017 (EP) ..... 17192555

(51) Int. Cl.
*B66B 5/22* (2006.01)

(52) U.S. Cl.
CPC ..... *B66B 5/22* (2013.01)

(58) Field of Classification Search
CPC ..... B66B 5/22; B66B 5/18
See application file for complete search history.

(56) References Cited

U.S. PATENT DOCUMENTS 3,215,231 A 11/1965 Lodige
5,370,208 A * 12/1994 De Jong ..... B66B 5/22 187/372
6,823,969 B2 11/2004 Simmonds et al.
9,162,848 B2 10/2015 Ascua et al.
9,663,327 B2 5/2017 Terry et al.
2009/0294220 A1 12/2009 Glaser
2017/0101292 A1 4/2017 Powers

FOREIGN PATENT DOCUMENTS

CN 2732701 Y 10/2005
CN 101759076 B 6/2012
CN 103482448 A 1/2014
CN 102190231 B 7/2014
CN 205838249 U 12/2016
(Continued)

OTHER PUBLICATIONS

European Search Report for application EP 17192555.5, dated Apr. 10, 2018, 7 pages.

*Primary Examiner* — Michael R Mansen
*Assistant Examiner* — Michelle M Lantrip
(74) *Attorney, Agent, or Firm* — Cantor Colburn LLP

(57) ABSTRACT

An elevator safety gear assembly for an elevator system comprises a first engagement member; a second engagement member; and a connector mechanically connecting the first and second engagement members with each other. The first and second engagement members are arranged opposite to each other defining a gap which is configured for accommodating a guide member extending in a longitudinal direction. At least one of the engagement members is movable in a direction which is inclined with respect to the longitudinal direction. The first engagement member is pivotably coupled to the connector by means of a first joint, and the second engagement member is pivotably coupled to the connector by means of a second joint. At least one of the joints is movable along the connector for changing the distance between the first and second joints.

14 Claims, 6 Drawing Sheets

(56) References Cited

FOREIGN PATENT DOCUMENTS

| | | | | | |
|---|---|---|---|---|---|
| CN | 104555789 | B | | 2/2017 | |
| EP | 0651724 | B1 | | 9/1999 | |
| EP | 1243824 | A1 | | 9/2002 | |
| EP | 1294631 | B1 | | 8/2004 | |
| EP | 1213248 | B1 | | 10/2006 | |
| EP | 1670710 | B1 | | 12/2010 | |
| EP | 2058262 | B1 | | 4/2011 | |
| EP | 2112115 | B1 | | 8/2012 | |
| FR | 634568 | A | | 2/1928 | |
| KR | 200437138 | Y1 | * | 11/2007 | ..... B66B 5/18 |
| KR | 20080019103 | A | | 3/2008 | |
| KR | 101227639 | B1 | | 2/2013 | |
| KR | 101665520 | B1 | | 10/2016 | |
| KR | 101745851 | B1 | | 6/2017 | |
| WO | 2004033354 | A1 | | 4/2004 | |
| WO | 2017017488 | A1 | | 2/2017 | |

* cited by examiner

ELEVATOR SAFETY GEAR ASSEMBLY

The invention relates to an elevator safety gear assembly, to an elevator system and an elevator car respectively comprising such an elevator safety gear assembly, and to a method of operating an elevator safety gear assembly.

An elevator system typically comprises at least one elevator car, which moves along a hoistway extending between a plurality of landings, and a driving member, which is configured for driving the elevator car. The elevator system may further include a counterweight moving concurrently and in opposite direction with respect to the elevator car. In order to ensure a safe operation, an elevator system usually further comprises at least one elevator safety gear assembly. The elevator safety gear assembly is configured for braking the movement of the elevator car and/or the counterweight relative to a guide member, such as a guide rail, in the event the movement of the elevator car and/or the counterweight exceeds a predetermined velocity or acceleration. The elevator safety gear assembly usually includes at least one engagement member that is configured for engaging the guide member when the elevator safety gear assembly is activated.

It would be beneficial to provide a reliable elevator safety gear assembly for an elevator system, which may be produced, installed and maintained at low costs.

According to an exemplary embodiment of the invention, an elevator safety gear assembly comprises a first engagement member, a second engagement member, and a connector mechanically connecting the first and second engagement members with each other. The first and second engagement members are arranged opposite to each other defining a gap which is configured for accommodating a guide member extending in a longitudinal direction. At least one of the engagement members is movable along a path which is inclined with respect to the longitudinal direction. The path in particular is inclined at an angle of more than 0° and less than 90°, in particular at an angle between 0° and 45°, more particularly at an angle between 0° and 10°, with respect to the longitudinal direction. The first engagement member is pivotably coupled to the connector by means of a first joint, and the second engagement member is pivotably coupled to the connector by means of a second joint. At least one of the joints is movable along the connector for changing the distance between the first and second joints and modifying the width of the gap between the two engagement members.

According to an exemplary embodiment of the invention, an elevator safety gear assembly comprises a first engagement member, which is movable along a first path having a first end and a second end, a second engagement member, which is movable along a second path having a first end and a second end, and a connector mechanically connecting the first and second engagement members with each other. The first and second engagement members are arranged opposite to each other defining a gap which is configured for accommodating a guide member extending in a longitudinal direction. The first and second paths are mirror-symmetrical with respect to a mirror-plane extending in the longitudinal direction, in particular along the center of the gap. The connector is a single rigid component, in particular a component which is rigid in a plane extending between the two engagement members. The connector is pivotably connected, e.g. by means of first and second joints, to the first and second engagement members, respectively.

Exemplary embodiments of the invention further include an elevator car and a counterweight respectively comprising at least one elevator safety gear assembly according to an exemplary embodiment of the invention.

Exemplary embodiments of the invention also include an elevator system comprising at least one guide member and at least one elevator car and/or at least one counterweight traveling along said at least one guide member, wherein said at least one elevator car and/or at least one counterweight comprise at least one elevator safety gear assembly according to an exemplary embodiment of the invention.

In an elevator system according to an exemplary embodiment of the invention, the elevator car and/or at least one counterweight are able to move freely along the guide member, when the engagement members are located in a first position (disengaged position), respectively. The engagement members are in engagement with the guide member braking any movement of the elevator car and/or at least one counterweight, when at least one of the engagement members is located in a second position (engaged position).

Exemplary embodiments of the invention also include a method of operating an elevator safety gear assembly, wherein the elevator safety gear assembly comprises a first engagement member, a second engagement member, and a connector mechanically connecting the first and second engagement members with each other. The first and second engagement members are arranged opposite to each other defining a gap which is configured for accommodating a guide member extending in a longitudinal direction. At least one of the engagement members is movable along a path which is inclined with respect to the longitudinal direction. The path in particular is inclined at an angle of more than 0° and less than 90°, in particular at an angle between 0° and 45°, more particularly at an angle between 0° and 10°, with respect to the longitudinal direction. The first engagement member is pivotably coupled to the connector by means of a first joint, and the second engagement member is pivotably coupled to the connector by means of a second joint. At least one of the joints is movable along the connector, which allows changing the distance between the first and second joints. The method includes moving at least one of the first and second engagement members, thereby moving at least one of the joints along the connector and changing the distance between the first and second joints in order to change the distance between the engagement members for engaging the engagement members with a guide member extending through the gap between the two engagement members.

In an elevator safety gear assembly according to an exemplary embodiment of the invention the connector controls the movement of the engagement members relative to each other. The at least one movable joint in particular allows adjusting the distance between the engagement members. As a result, only one of the engagement members needs to be activated for activating the elevator safety gear assembly. An elevator safety gear assembly according to an exemplary embodiment of the invention comprises a simple connector, which may be produced and installed easily at low cost.

A number of optional features are set out in the following. These features may be realized in particular embodiments, alone or in combination with any of the other features.

The first joint may comprise a first opening formed within the connector and a first pin extending through the first opening. The second joint may comprise a second opening formed within the connector and a second pin extending through the second opening. At least one of the openings may be an elongated opening. A pin, which is rotatably accommodated in an opening, provides a reliable joint. A joint comprising an elongated opening allows the accommodated pin to move along the connector changing its distance with respect to the other opening.

One of the openings may be a circular opening which does not allow the accommodated pin to move linearly with respect to the connector. In an alternative embodiment, both openings may be elongated openings.

The connector may be rigid, in particular against deformation in a plane extending between the two engagement members. In consequence, the possible movements of the engagement members are defined by the shape of the connector and the elongated opening, and there is no additional degree of freedom provided by flexing the connector. The connector, however, may be flexible in a dimension which is perpendicular to the direction of movement of the engagement members.

The connector in particular may be made of a rigid material, such as metal, in particular steel, which may be machined conveniently in order to form the necessary openings. The connector in particular may be made of sheet-metal.

The connector may be arranged in an inclined orientation with respect to the longitudinal direction. The connector in particular may be oriented at an angle $\alpha$ of 20° to 40° with respect to the longitudinal direction. The angle $\alpha$ may change in the course of the movement of the engagement members between the disengaged and engaged positions. The angle $\alpha$ may be in the range of 32° to 40°, in particular in the range of 34° to 38° when the engagement members 26, 28 are located in their disengaged positions.

The first engagement member may be movable along a first path and the second engagement member may be movable along a second path. Each path in particular may have a first end and a second end, respectively, wherein the gap between the engagement members has a first width when the engagement members are positioned at the first ends of the paths, and wherein the gap between the engagement members has a second width when the engagement members are positioned at the second ends of the paths, respectively. The second width in particular may differ from the first width.

Such a configuration results in a change of the distance between two engagement members when moving along said paths. It in particular may cause the engagement members to engage with a guide member extending through the gap between the two engagement members, said engagement braking the movement of the elevator car and/or counterweight with respect to the guide member.

The path of each engagement member may extend along a straight line, respectively. The paths in particular may be inclined with respect to each other so that the distance between the paths differs at both ends of the paths. An inclined orientation of the paths results in a change of the distance between two engagement members when moving along said paths.

The first and second paths may be mirror-symmetrical with respect to a mirror-plane extending in the longitudinal direction. A symmetrical movement of the engagement members causes a symmetric braking of the elevator car or counterweight. A symmetric braking avoids that the braking causes a horizontal displacement of the elevator car or counterweight, respectively. Such a horizontal displacement could damage the elevator system, in particular guiding elements such as sliding guides or roller guides (not shown), which may be used for guiding the elevator car or counterweight along its corresponding guide member.

The first path may be defined by a first slot extending on a first side of the gap and the second path may be defined by a second slot extending on a second side of the gap. The first and second slots in particular may be formed mirror-symmetrically with respect to the mirror-plane. Each of the first and second engagement members may comprise at least one protrusion extending into the first or second slot, respectively.

In such a configuration the engagement members are reliably guided along their respective path by interaction of the protrusion(s) provided at each engagement member with the corresponding slot. A guidance provided by a combination of a slot and corresponding protrusions may be produced with the necessary accuracy and strength in order to accommodate the forces acting on the guide members when the elevator safety gear assembly is activated for braking the elevator car and/or counterweight.

The elevator safety gear assembly may further comprise at least one elastic member, which is configured for elastically supporting at least one of the engagement members in order to control the interaction between the at least one of the engagement members and the guide member when the elevator safety gear assembly is activated.

In the following, exemplary embodiments of the invention are described in more detail with respect to the enclosed figures:

FIG. 1 schematically depicts an elevator system according to an exemplary embodiment of the invention.

Figure 1:
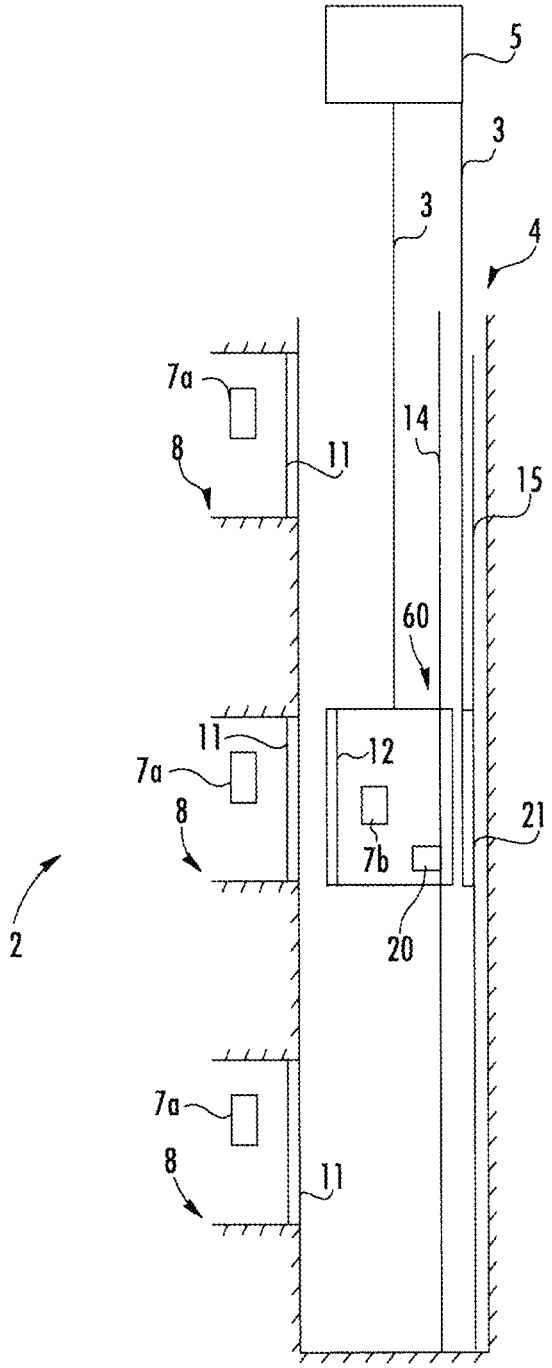

FIG. 1 schematically depicts an elevator system 2 according to an exemplary embodiment of the invention.

The elevator system 2 includes an elevator car 60 which is movably arranged within a hoistway 4 extending between a plurality of landings 8. The elevator car 60 in particular is movable along a plurality of car guide members 14, such as guide rails, extending along the vertical direction of the hoistway 4. Only one of said car guide members 14 is visible in FIG. 1. Although only one elevator car 60 is depicted in FIG. 1, the skilled person will understand that exemplary embodiments of the invention may include elevator systems 2 having a plurality of elevator cars 60 moving in one or more hoistways 4.

The elevator car 60 is movably suspended by means of a tension member 3. The tension member 3, for example a rope or belt, is connected to a drive unit 5, which is configured for driving the tension member 3 in order to move the elevator car 60 along the height of the hoistway 4 between the plurality of landings 8, which are located on different floors.

Each landing 8 is provided with a landing door 11, and the elevator car 60 is provided with a corresponding elevator car door 12 for allowing passengers to transfer between a landing 8 and the interior of the elevator car 60 when the elevator car 60 is positioned at the respective landing 8.

The exemplary embodiment shown in FIG. 1 uses a 1:1 roping for suspending the elevator car 60. The skilled person, however, easily understands that the type of the roping is not essential for the invention and that different kinds of roping, e.g. a 2:1 roping or a 4:1 roping may be used as well. The elevator system 2 includes a counterweight 21, which is attached to the tension member 3 opposite to the elevator car 60 and which moves along at least one counterweight guide member 15. The skilled person will understand that the invention may be applied also to elevator systems 2 which do not comprise a counterweight 21.

The tension member 3 may be a rope, e.g. a steel core, or a belt. The tension member 3 may be uncoated or may have a coating, e.g. in the form of a polymer jacket. In a particular embodiment, the tension member 3 may be a belt comprising a plurality polymer coated steel cords (not shown). The elevator system 2 may have a traction drive including a traction sheave for driving the tension member 3. In an alternative configuration, which is not shown in the figures, the elevator system 2 may be an elevator system 2 without a tension member 103, comprising e.g. a hydraulic drive or a linear drive. The elevator system 2 may have a machine room (not shown) or may be a machine room-less elevator system.

The drive unit 5 is controlled by an elevator control unit (not shown) for moving the elevator car 60 along the hoistway 4 between the different landings 8.

Input to the control unit may be provided via landing control panels 7*a*, which are provided on each landing 8 close to the landing doors 11, and/or via an elevator car control panel 7*b*, which is provided inside the elevator car 60.

The landing control panels 7*a* and the elevator car control panel 7*b* may be connected to the elevator control unit by means of electrical wiring, which are not shown in FIG. 1, in particular by an electric bus, or by means of wireless data connections.

The elevator car 60 is equipped with at least one elevator safety gear assembly 20, which is schematically illustrated at the elevator car 60. Alternatively or additionally, the counterweight 21 may be equipped with at least one elevator safety gear assembly 20, which, however, is not shown in FIG. 1.

The elevator safety gear assembly 20 is operable to brake or at least assist in braking (i.e. slowing or stopping the movement) of the elevator car 60 relative to a car guide member 14 by engaging with the car guide member 14. In the following, the structure and the operating principle of an elevator safety gear assembly 20 according to an exemplary embodiment of the invention will be described.

Figure 2:
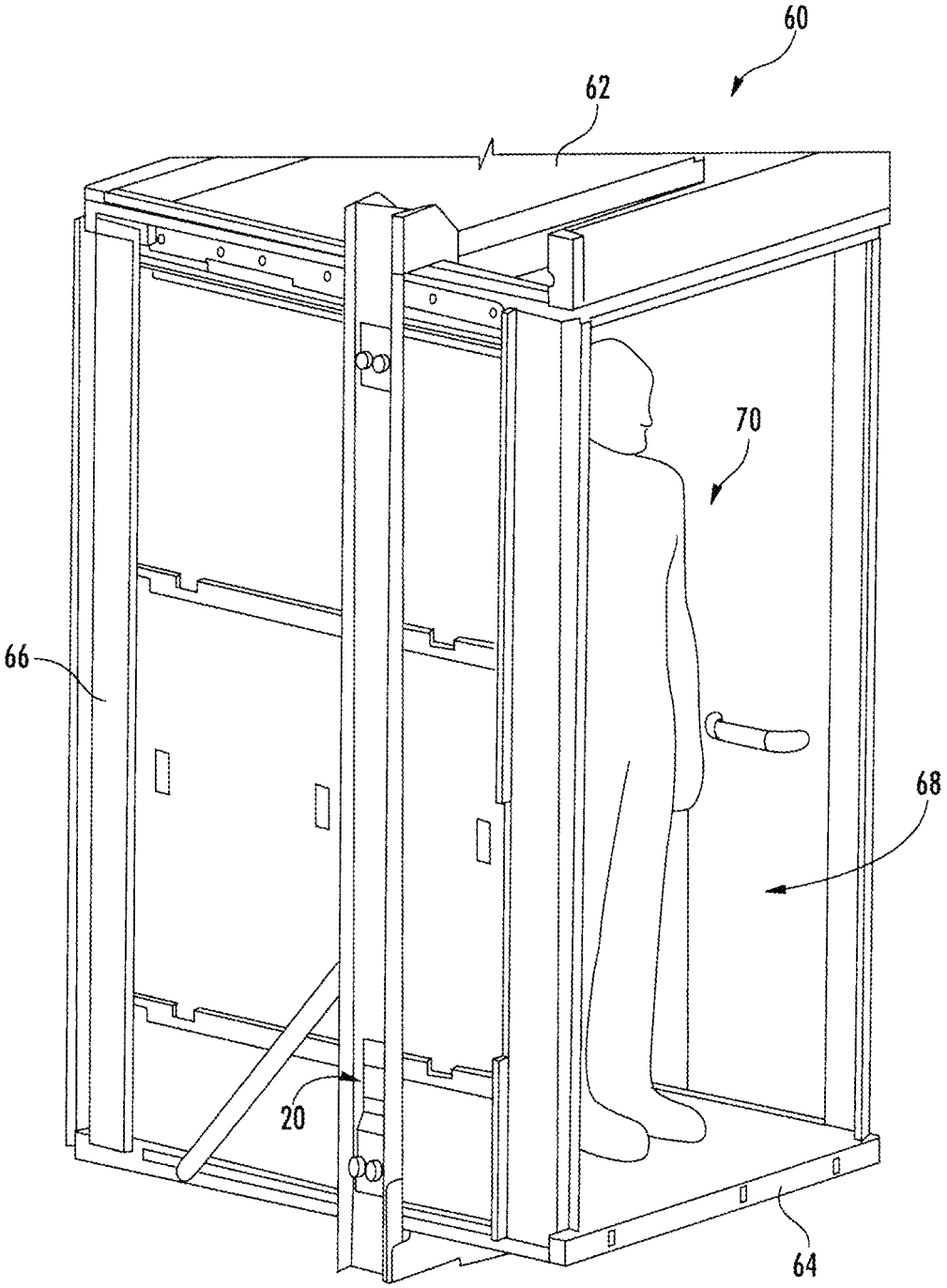
FIG. 2 shows a perspective view of an elevator car according to an exemplary embodiment of the invention.

FIG. 2 is an enlarged view of an elevator car 60 according to an exemplary embodiment of the invention. The elevator car 60 includes a car roof 62, a car floor 64 and a plurality of car side walls 66. In combination, the car roof 62, the car floor 64 and the plurality of side walls 66 define an interior space 68 for accommodating and carrying passengers 70 and/or cargo (not shown).

An elevator safety gear assembly 20 according to an exemplary embodiment of the invention is attached to a side wall 66 of the elevator car 60.

Although only one elevator safety gear assembly 20 is depicted in FIGS. 1 and 2, the skilled person will understand that a plurality of safety gear assemblies 20 may be employed in combination with a single elevator car 60. In particular, in a configuration in which the elevator system 2 comprises a plurality of car guide members 14, an elevator safety gear assembly 20 may be associated with each car guide member 14. Alternatively or additionally, two or more elevator safety gear assembly 20 may be provided on top of each other at the same sidewall 66 of the elevator car 60 in order to engage the same car guide member 14.

Figure 3:
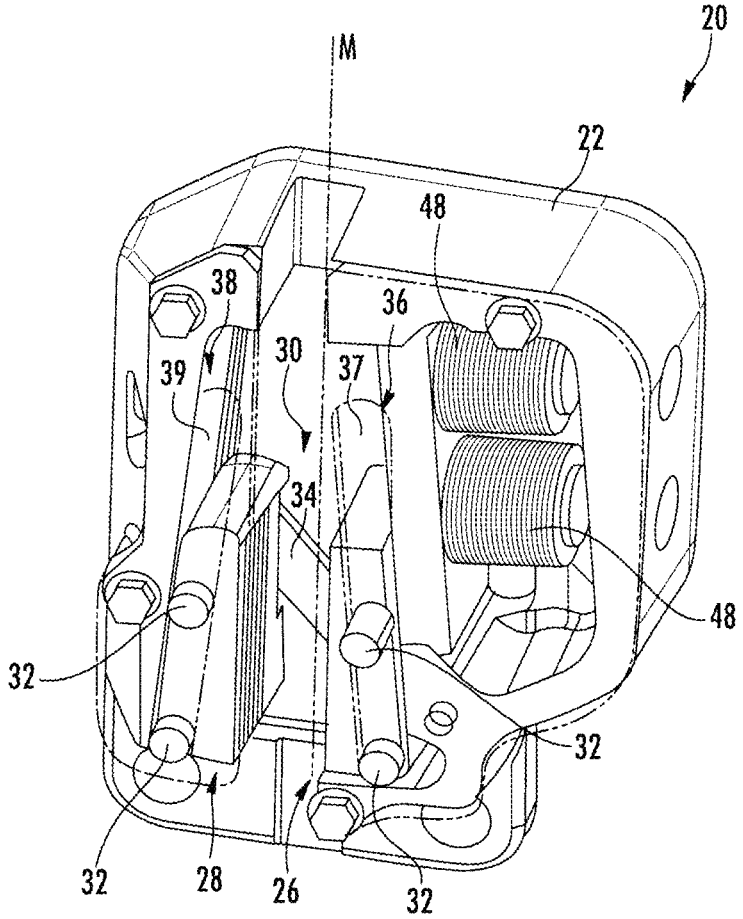
FIG. 3 shows a perspective view of an elevator safety gear assembly according to an exemplary embodiment of the invention.
Figure 4A:
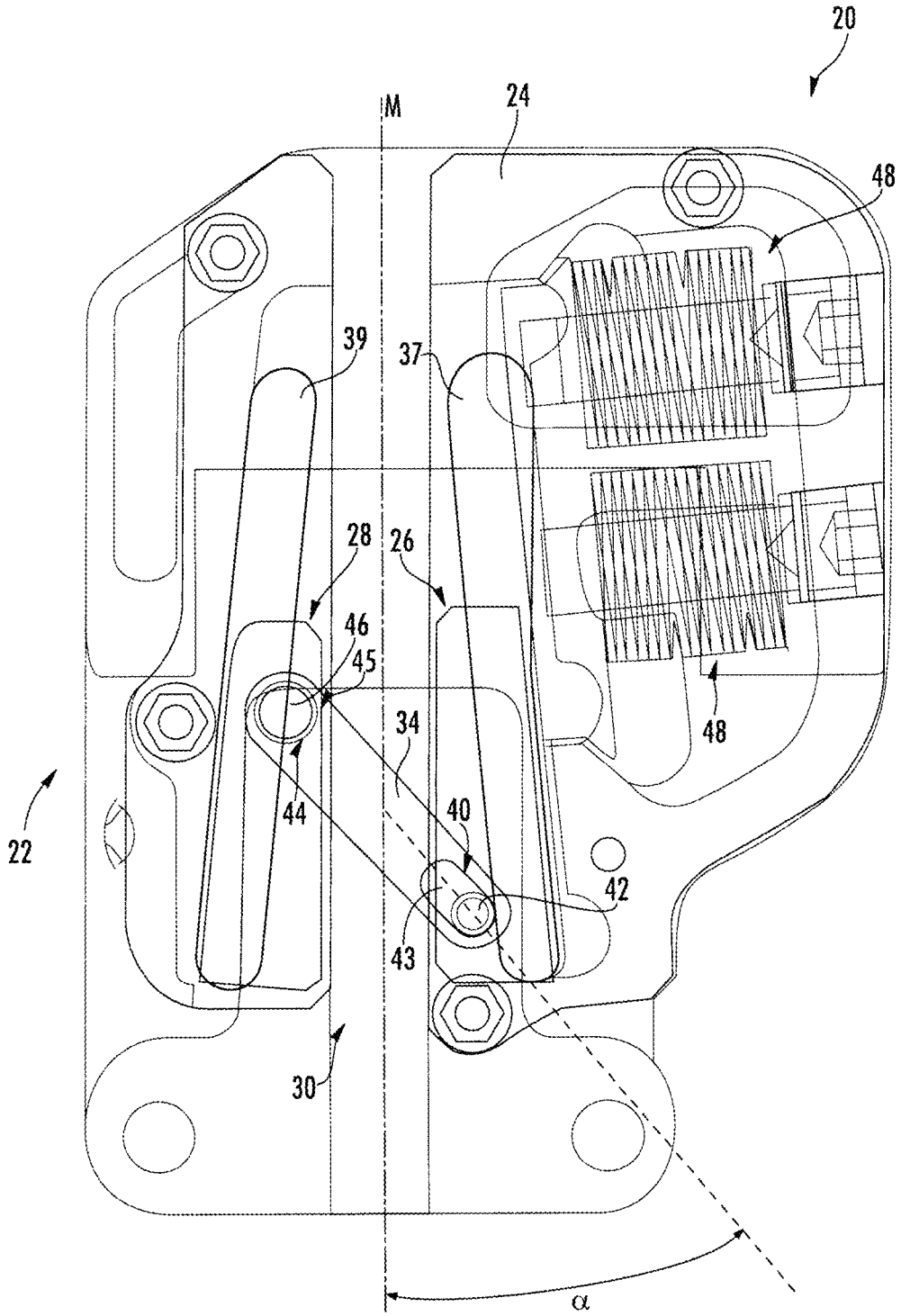
FIG. 4A shows a plan view of an elevator safety gear assembly shown in FIG. 3.

FIG. 3 depicts a perspective view of an elevator safety gear assembly 20 according to an exemplary embodiment of the invention, and FIG. 4A shows a plan view thereof.

The elevator safety gear assembly 20 comprises a housing 22, which is covered by a cover plate 24. In order to allow viewing into the elevator safety gear assembly 20, the cover plate 24 is not shown in FIG. 3. In FIG. 4A, the components of the elevator safety gear assembly 20 including the cover plate 24 are depicted transparently, i.e. only the outlines of the components are shown, in order to illustrate the internal structure of the elevator safety gear assembly 20. The elevator safety gear assembly 20 comprises a first engagement member 26 and a second engagement member 28.

Figure 4B:
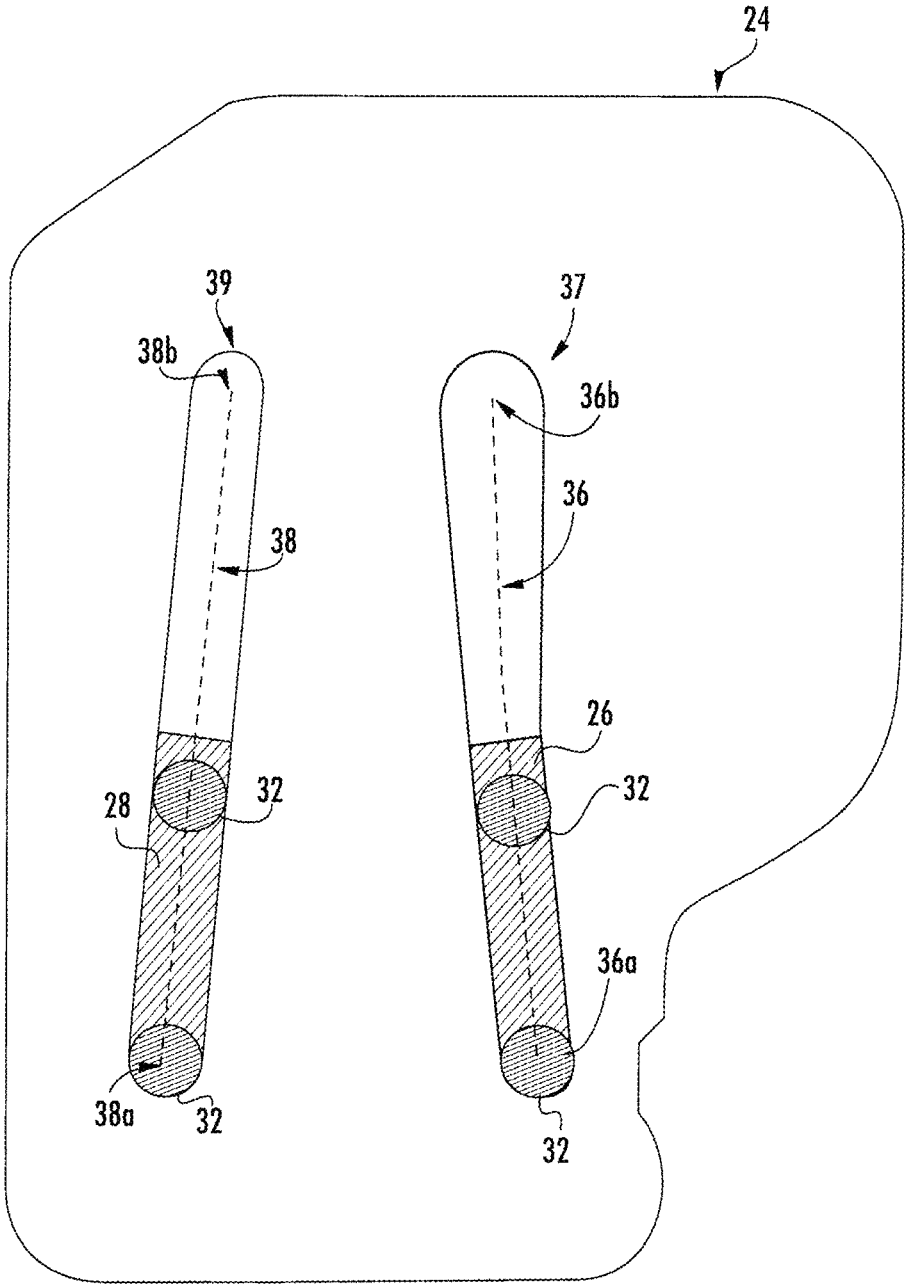
FIG. 4B shows a plan view of a cover plate as it is employed in the elevator safety gear assembly shown in FIGS. 3 and 4A.

A plan view of the cover plate 24 with the engagement members 26, 28 being positioned behind the cover plate 24 is shown in FIG. 4B.

The first and second engagement members 26, 28 are arranged opposite to each other defining a gap 30 in between. The gap 30 is configured for accommodating a guide member 14, 15 of the elevator system 2 (cf. FIGS. 1, 5 and 6) extending in a longitudinal direction, which is the vertical direction in the figures.

The first and second engagement members 26, 28 are supported within the housing 22 by a support structure.

Said support structure includes first and second slots 37, 39 formed in the cover plate 24. Each of the engagement members 26, 28 is provided with two protrusions 32 extending into the corresponding slot 37, 39 (cf. FIG. 4B). Thus, the first engagement member 26 is guided by its protrusions 32 along the first slot 37 defining a first path 36, and the second engagement member 28 is guided by its protrusions 32 along the second slot 39 defining a second path 38. The first and second paths 36, 38 are depicted as broken lines in FIG. 4B.

The slots 37, 39 and in consequence the paths 36, 38 extend along straight lines, respectively. The slots 37, 39 and the paths 36, 38 are inclined with respect to the longitudinal direction. As a result, the gap 30 has a smaller width when the engagement members 26, 28 are positioned at second (upper) ends 36*b*, 38*b* of the paths 36, 38 compared to a configuration in which the engagement members 26, 28 are positioned at first (lower) ends 36*a*, 38*a* of the paths 36, 38 (cf. FIG. 4B).

The slots 37, 39 in particular are provided in a configuration which results in paths 36, 38 of the engagement members 26, 28 which are basically mirror-symmetrical with respect to a mirror-plane M extending in the longitudinal direction along the center of the gap 30.

Each engagement member 26, 28 is provided with a pin 42, 46 extending from a side facing away from the cover plate 24. In the orientation of the elevator safety gear assembly 20 shown in FIG. 3, the pins 42, 46 are not visible as they extend to the rear side of the figure and are covered by the engagement members 26, 28.

FIG. 4A shows that a first pin 42 is provided at a lower portion of the first engagement member 26 and a second pin 46 is provided at an upper portion of the second engagement member 28. This, however, is only an exemplary configuration, and the first and second pins 42, 46 may be provided at any position on the engagement members 26, 28 which is suitable in the specific configuration.

A connector 34 extending between the pins 42, 46 mechanically connects the two engagement members 26, 28 with each other. The connector 34 is a single component or element made of a rigid material, such as metal. The connector 34 is provided with a first opening 43 accommodating the first pin 42 and a second opening 45 accommodating the second pin 46. Each pin 42, 46 is rotatably accommodated within the corresponding opening 43, 45. As a result, the combination of the first pin 42 and the first opening 43 provides a first joint 40, and the combination of the second pin 46 and the second opening 45 provides a second joint 44 allowing the connector 34 to pivot with respect to the engagement members 26, 28, respectively.

At least one of the openings 43, 45, in the configuration shown in FIGS. 3 and 4 the first opening 43, is an elongated opening 43. The elongated opening 43 allows the first pin 42, which is accommodated in said first opening 43, not only to rotate with respect to the connector 34, but additionally to move linearly along the length of the connector 34. Said linear movement allows changing the distance between the first and second pins 42, 46 and in consequence changing the distance between the engagement members 26, 28 when moving along their respective paths 36, 38.

The connector 34 is arranged in an inclined orientation with respect to the longitudinal direction, which is represented by the mirror-plane M in FIG. 4A. The connector 34 in particular may be oriented at an angle $\alpha$ of 20° to 40° with respect to the longitudinal direction. The angle $\alpha$ may change in the course of the movement of the engagement members 26, 28 between the disengaged and engaged positions. The angle $\alpha$ may be in the range of 32° to 40°, in particular in the range of 34° to 38° when the engagement members 26, 28 are located in their disengaged positions depicted in FIG. 4A.

The elevator safety gear assembly 20 further comprises two elastic members 48. The elastic members 48 are configured to elastically support the first engagement member 26 when it is positioned in the engaged position at the second end 36*b* of its path 36.

In the embodiment shown in FIGS. 4A, and 4B the upper portion of the slot 37 next to the elastic members 48, i.e. the first (right) slot 37 shown in FIGS. 4A and 4B, is slightly wider than the respective upper portion of the other slot 39, i.e. the second (left) slot 39 shown in FIGS. 4A and 4B, which is more distant from the elastic members 48 than the first slot 37. Such a configuration allows for a small lateral movement of the first engagement member 26 when it is located at the second (upper) end 36*b* of the first path 36 and interacts with the elastic members 48. Despite this small difference between the first and second slots 37, 39, the configuration depicted in FIGS. 4A and 4B is still considered as a "symmetrical configuration".

Figure 5:
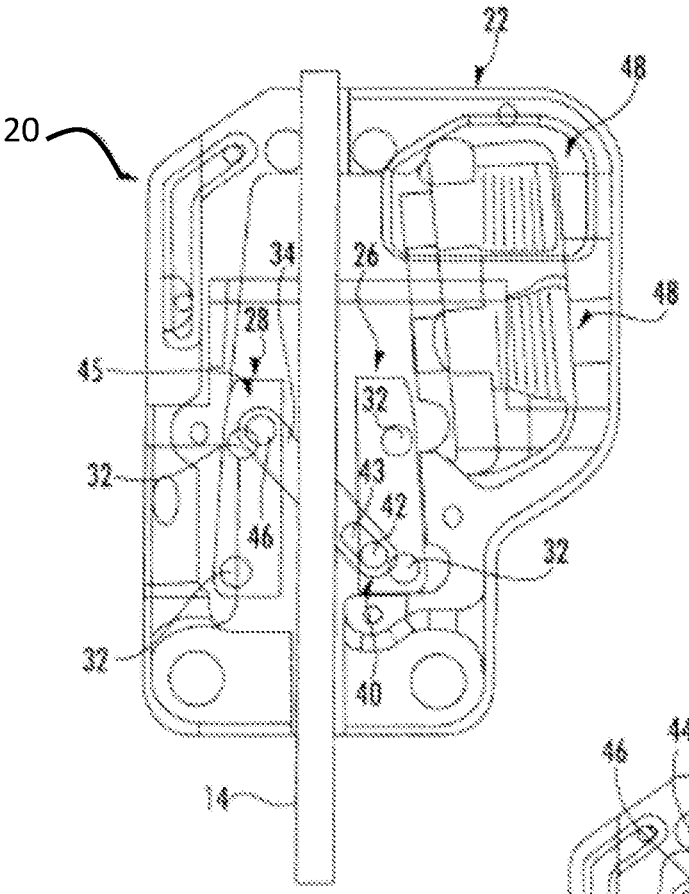
FIG. 5 shows a plan view of the elevator safety gear assembly with the engagement members being positioned in the disengaged position.
Figure 6:
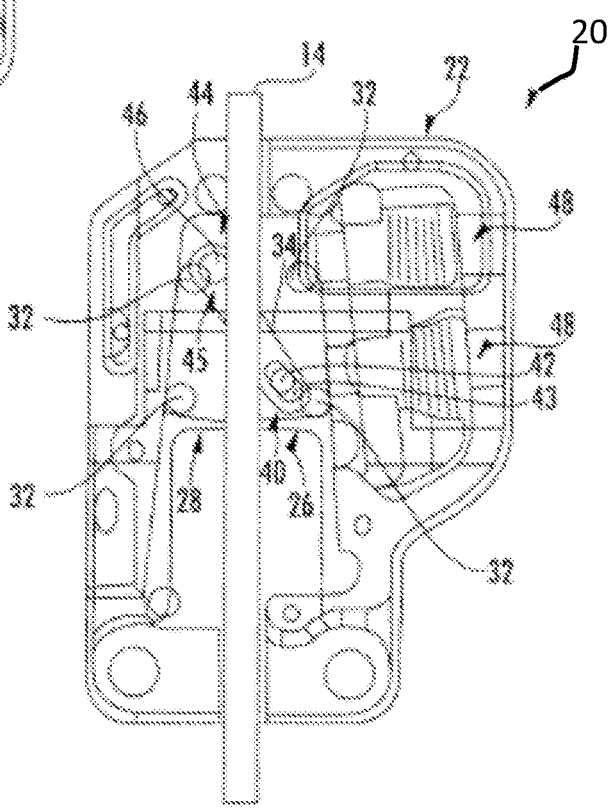
FIG. 6 shows a plan view of the elevator safety gear assembly with the engagement members being positioned in the engaged position.

The operating principle of the elevator safety gear assembly 20 shown in FIGS. 3 and 4 is illustrated in FIGS. 5 and 6:

FIG. 5 basically corresponds to FIG. 4A. FIG. 5 additionally depicts a car guide member 14 extending through the gap 30 formed between the two engagement members 26, 28.

As in FIG. 3, the cover plate 24 is omitted in FIGS. 5 and 6 in order to illustrate the internal structure of the elevator safety gear assembly 20. A car guide member 14 is shown in FIGS. 5 and 6, but the skilled person will understand that the guide member could also be a counterweight guide member 15 in case the elevator safety gear assembly 20 is attached to a counterweight 21.

FIG. 5 in particular illustrates a disengaged state of the elevator safety gear assembly 20. In the disengaged state, the first and second engagement members 26, 28 are positioned at the first ends 36*a*, 38*a* of their respective paths 36, 38, respectively. In consequence, the gap 30 between the first and second engagement members 26, 28 is relatively wide, i.e. the distance between the engagement members 26, 28 is relatively large, so that the engagement members 26, 28 do not contact the guide member 14. As a result, the elevator car 60 may move freely along the guide member 14.

In order to activate the elevator safety gear assembly 20, a safety actuator (not shown) pulls at least one of the engagement members 26, 28 out of its disengaged position at the first end 36*a*, 38*a* of its path 36, 38 towards the second end 36*b*, 38*b* of the respective path 36, 38 (cf. FIG. 4B). The safety actuator may be an electric/electronic actuator, a mechanic actuator including a pneumatic or hydraulic actuator, or a combination thereof.

Since the first and second engagement members 26, 28 are mechanically coupled by the connector 34, the movement of one of the engagement members 26, 28 causes the other engagement member 28, 26 to move out of its disengaged position at the first end 38*a*, 36*a* of its path 38, 36 towards the second end 38*b*, 36*b* of the path 38, 36 as well.

In consequence, the gap 30 between the first and second engagement members 26, 28 narrows, i.e. the distance between the engagement members 26, 28 decreases, and the first and second engagement members 26, 28 engage with the guide member 14, which is sandwiched between them. The engagement of the engagement members 26, 28 with the guide member 14 generates a frictional force braking the movement of the elevator car 60 along the guide member 14.

In order to enhance the braking performance, the surfaces of the engagement members 26, 28 facing and engaging the guide member 14 may be provided with frictional coatings enhancing the friction between the engagement members 26, 28 and the guide member 14.

The engaged position of the engagement members 26, 28 is illustrated in FIG. 6.

When the first engagement member 26 is positioned in or close to the second end 36*b* of its path 36, the elastic members 48, such as springs, control the normal force pressing the first engagement member 26 against the guide member 14.

In the illustrated embodiment, the engagement members 26, 28 are wedge members, but it is to be appreciated that alternative elements, which are suitable for frictional engagement with the guide member 14, may be used as well. For example, the engagement members 26, 28 may be provided as or include roller members, which are configured for engaging with the guide member 14.

The arrangement of the first and second engagement members 26, 28 of the exemplary embodiment disclosed in the figures is referred to as a "symmetric arrangement", based on the symmetric positioning of the engagement members 26, 28 on opposite sides of the guide member 14. In such a symmetric arrangement, it is important to synchronize the movement of the engagement members 26, 28 subsequent to the actuation of at least one of the engagement members 26, 28 by means of the safety actuator.

In the disclosed exemplary embodiment, the elastic members 48 directly interact with only one of the two engagement members 26, 28. In the illustrated embodiment, the elastic members 48 directly interact only with the first engagement member 26, which is shown on the right side of FIGS. 3 to 6. Said direct actuation of the first engagement member 26 needs to be transferred indirectly to the second engagement member 28, but in a manner that facilitates the desired symmetric movement of the engagement members 26, 28, as described above.

It is to be appreciated that completely symmetric operation of the engagement members 26, 28 is not required. It in particular is not necessary that the first and second engagement members 26, 28 move completely symmetrically from the disengaged position shown in FIG. 5 to the engaged position shown in FIG. 6. The speeds and positions of the two engagement members 26, 28 along their paths 36, 38 may change and they in particular differ from each other throughout their movement. However, at the end, the movement of the engagement members 26, 28 usually results in a symmetric configuration of the engagement members 26, 28 as it is illustrated in FIG. 6.

There further may be small asymmetrical displacements of the engagement members 26, 28 due to the fact that elastic members 48 are located only on one side of the elevator safety gear assembly 20, and their small compression may result in small asymmetry in the movement of the engagement members 26, 28.

The arrangement illustrated in the figures is still referred to as a "symmetric arrangement" based on the symmetric configuration of the paths 36, 38 and slots 37, 39 and the fact that the extent of asymmetry is considered negligible.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention shall not be limited to the particular embodiment disclosed, but that the invention includes all embodiments falling within the scope of the dependent claims.

REFERENCES

2 elevator system
3 tension member
4 hoistway
5 drive unit
7*a* landing control panel
7*b* elevator car control panel
8 landing
11 landing door
12 elevator car door
14 car guide member
15 counterweight guide member
20 elevator safety gear assembly
21 counterweight
22 housing
24 cover plate
26 first engagement member
28 second engagement member
30 gap
32 protrusion
34 connector
36 first path
36*a* first end of the first path
36*b* second end of the first path
37 first slot
38 second path
38*a* first end of the second path
38*b* first end of the second path
39 second slot
40 first joint
43 first opening
42 first pin
44 second joint
45 second opening
46 second pin
48 elastic element
60 elevator car
62 car roof
64 car floor
66 car side wall
68 interior space of the elevator car
70 passenger
M mirror-plane

What is claimed is:

1. An elevator safety gear assembly for an elevator system comprising:

a first engagement member;

a second engagement member; and a connector mechanically connecting the first and second engagement members with each other, wherein the first and second engagement members are arranged opposite to each other defining a gap which is configured for accommodating a guide member extending in a longitudinal direction;

wherein at least one of the engagement members is movable in a direction which is inclined with respect to the longitudinal direction;

wherein the first engagement member is pivotably coupled to the connector by means of a first joint;

wherein the second engagement member is pivotably coupled to the connector by means of a second joint; and wherein at least one of the joints is movable along the connector for changing the distance between the first and second joints;

wherein the connector is inclined with respect to the longitudinal direction at an angle $\alpha$ of 20° to 40°.

2. The elevator safety gear assembly according to claim 1, wherein the first joint comprises a first opening formed within the connector and a first pin extending through the first opening wherein the second joint comprises a second opening formed within the connector and a second pin extending through the second opening, and wherein at least one of the openings is an elongated opening allowing the accommodated pin to change its distance with respect to the other opening.

3. The elevator safety gear assembly according to claim 2, wherein one of the openings is a circular opening preventing linear movement of the accommodated pin with respect to the connector.

4. The elevator safety gear assembly according to claim 1, wherein the connector is an elongated bar extending between the two engagement members, wherein the connector in particular is rigid and/or made of metal.

5. The elevator safety gear assembly according to claim 1, wherein the first engagement member is movable along a first path and wherein the second engagement member is movable along a second path, wherein each path has a first end and a second end, respectively, wherein the gap between the engagement members has a first width when the engagement members are positioned at the first ends, and a second width when the engagement members are positioned at the second ends, wherein the second width in particular differs from the first width.

6. The elevator safety gear assembly according to claim 5, wherein each path extends along a straight line, wherein each path in particular is inclined with respect to the other path.

7. The elevator safety gear assembly according to claim 5, wherein the first and second paths are mirror-symmetrical with respect to a mirror-plane (M) extending in the longitudinal direction.

8. The elevator safety gear assembly according to claim 5, wherein the first path is defined by a first slot extending on a first side of the gap and wherein the second path is defined by a second slot extending on a second side of the gap, wherein each of the first and second engagement members in particular comprises at least one protrusion extending into the first or second slot, respectively.

9. The elevator safety gear assembly according to claim 1, further comprising at least one elastic member which is configured for elastically supporting at least one of the engagement members.

10. A counterweight for an elevator system, the counterweight comprising at least one elevator safety gear assembly according to claim 1.

11. An elevator system comprising at least one counterweight guide member and the counterweight according to claim 10 traveling along said at least one counterweight guide member.

12. The elevator system according to claim 11, wherein the counterweight is able to move freely along the at least one counterweight guide member, when the engagement members are located in a first position; and wherein the engagement members are in engagement with the at least one counterweight guide member braking any movement of the counterweight elevator car, when at least one of the engagement members is located in a second position.

13. An elevator car comprising at least one elevator safety gear assembly according to claim 1.

14. Method of operating an elevator safety gear assembly, comprising:

a first engagement member;

a second engagement member; and a connector mechanically connecting the first and second engagement members with each other, wherein the connector is inclined with respect to the longitudinal direction at an angle $\alpha$ of 20° to 40°;

wherein the first and second engagement members are arranged opposite to each other defining a gap which is configured for accommodating a guide member extending in a longitudinal direction;

wherein at least one of the engagement members is movable in a direction which is inclined with respect to the longitudinal direction;

wherein the first engagement member is pivotably coupled to the connector by means of a first joint;

wherein the second engagement member is pivotably coupled to the connector by means of a second joint; and wherein at least one of the joints is movable along the connector for changing the distance between the first and second joints;

wherein the method includes moving at least one of the first and second engagement members thereby moving at least one of the joints along the connector and changing the distance between the first and second joints.

* * * * *